US006074152A

United States Patent [19]

Vecchi

[11] Patent Number: 6,074,152

[45] Date of Patent: Jun. 13, 2000

[54] BINDING MACHINE, PARTICULARLY FOR INDEX-BOOKS, NOTEBOOKS AND THE LIKE

[75] Inventor: Marcello Vecchi, Milan, Italy

[73] Assignee: PRIMA S.r.l., Milan, Italy

[21] Appl. No.: 09/122,327

[22] Filed: Jul. 24, 1998

[30] Foreign Application Priority Data

Aug. 4, 1997 [IT] Italy ..... MI970596 U
May 20, 1998 [IT] Italy ..... MI98A1114

[51] Int. Cl.[7] ..... B42B 5/08

[52] U.S. Cl. ..... 412/39; 412/7; 412/16; 412/40; 412/39

[58] Field of Search ..... 412/6, 7, 22, 33, 412/38, 39, 40, 42, 43

[56] References Cited

U.S. PATENT DOCUMENTS

| | | | |
|---|---|---|---|
| 2,603,801 | 7/1952 | Emmer | 412/40 |
| 4,354,701 | 10/1982 | Marshall | 294/1 |
| 4,364,737 | 12/1982 | Sowden | 493/346 |
| 5,015,114 | 5/1991 | Miller | 402/4 |
| 5,143,502 | 9/1992 | Kaufmann et al. | 412/16 |
| 5,299,898 | 4/1994 | Kaufmann et al. | 412/7 |
| 5,431,519 | 7/1995 | Baumann | 412/7 |
| 5,447,402 | 9/1995 | Kobayashi | 412/33 |
| 5,464,312 | 11/1995 | Hotkowski et al. | 412/7 |
| 5,549,433 | 8/1996 | Byrne | 412/39 |
| 5,683,218 | 11/1997 | Mori | 412/40 |

FOREIGN PATENT DOCUMENTS

| | | |
|---|---|---|
| 0574777 | 12/1993 | European Pat. Off. . |
| 994423 | 11/1951 | France . |

*Primary Examiner*—Willmon Fridie, Jr.
*Assistant Examiner*—Alisa L. Thurston
*Attorney, Agent, or Firm*—Guido Modiano; Albert Josif; Daniel O'Byrne

[57] ABSTRACT

A binding machine, particularly for index-books, notebooks and the like, comprising a section for binding sheets by means of a plurality of mutually aligned disks having a double-T cross-section; means suitable to arrange a plurality of sheets stacked with an edge portion at the binding section; and presser means which are suitable to act on the edge portion of the sheets in order to insert the disks in seats formed in the sheets.

26 Claims, 7 Drawing Sheets

BINDING MACHINE, PARTICULARLY FOR INDEX-BOOKS, NOTEBOOKS AND THE LIKE

BACKGROUND OF THE INVENTION

The present invention relates to a binding machine, particularly for index-books, notebooks and the like.

A conventional binding system for producing notebooks, index-books and the like is constituted by a plurality of disks having a double-T cross-section which are suitable to engage corresponding seats formed in the sheets so as to detachably retain said sheets.

This binding system allows the user to remove and reinsert the sheets in different positions quickly and easily and is therefore highly advantageous.

Accordingly, the need is felt for a binding machine which can produce small runs of notebooks with this binding system for example in an office.

SUMMARY OF THE INVENTION

The aim of the present invention is therefore to provide a binding machine, particularly for index-books, notebooks and the like, having a low cost and suitable for small-run production.

Within the scope of this aim, an object of the present invention is to provide a binding machine, particularly for index-books, notebooks and the like, which allows both automated and manual positioning of the disks, is simple to manufacture and reliable.

Another object of the present invention is to provide a binding machine which is very easy and quick to use.

This aim, these objects and others which will become apparent hereinafter are achieved by a binding machine, particularly for index-books, notebooks and the like, comprising a section for binding sheets by means of a plurality of mutually aligned disks having a double-T cross-section; means suitable to arrange a plurality of sheets stacked with an edge portion at said binding section; and presser means suitable to act on said edge portion of said sheets in order to insert said disks in seats formed in said sheets.

BRIEF DESCRIPTION OF THE DRAWINGS

Further characteristics and advantages of the present invention will become apparent from the following detailed description of a binding machine, particularly for index-books, notebooks and the like, illustrated only by way of non-limitative example in the accompanying drawings, wherein.

DESCRIPTION OF THE PREFERRED EMBODIMENTS

Figure 2:
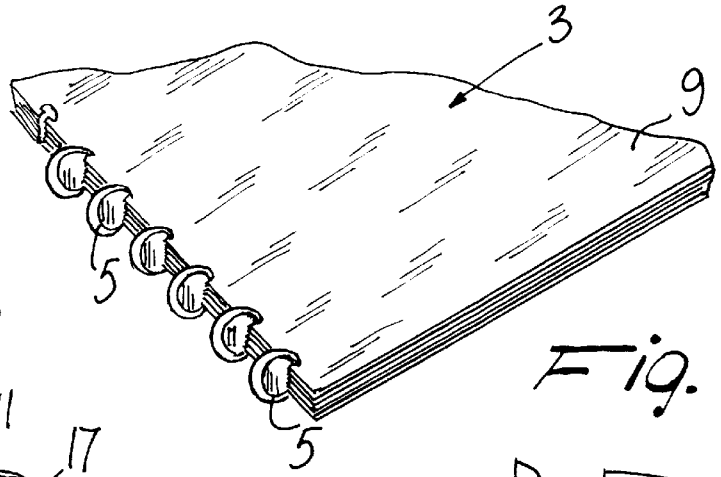
FIG. 2 is a partial perspective view of a notebook, partially bound by means of the binding machine according to the present invention shown in FIG. 1.
Figure 3:
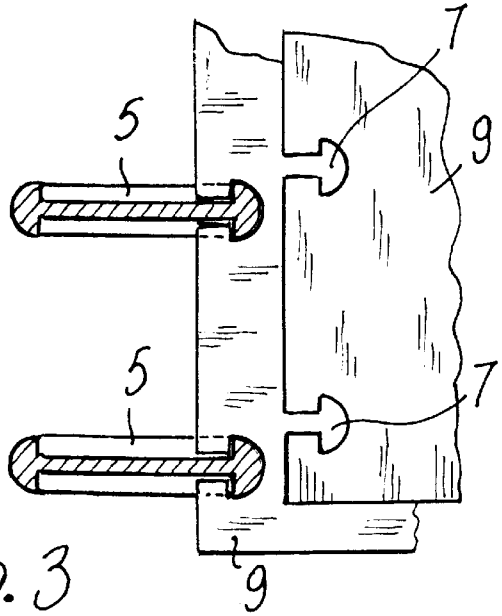
FIG. 3 is an enlarged-scale and partially sectional plan view of a detail of the notebook of FIG. 2.

With reference to FIGS. 1 to 10, the binding machine according to the present invention, in a first embodiment generally designated by the reference numeral 1, is suitable to bind notebooks 3 or the like by means of a plurality of disks 5 which are suitable to engage corresponding seats 7 formed in the individual sheets 9 that constitute the notebook 3 or the like.

The binding machine 1 comprises conveyor means 11, constituted by a plurality of parallel guides, which are suitable to convey the disks 5 so as to arrange a row of disks in a binding position 13.

In the binding position, a rod 15 which is pivoted to the rear and oscillates in contrast with a spring (not shown) prevents the disks from disengaging from the guides 11 when no sheets 9 are present in the binding position 13.

In the same binding position presser means are provided, constituted by a lever 17, which is pivoted to the rear and is kept raised by a spring (not shown). The lever 17 has a plurality of pressers 19 which are suitable to act on the edge portion of the sheets 9 at the seats 7 for the disks 5.

Since the disks 5 can have different diameters according to the type of binding, in order to correctly arrange the disks in the guides 11 regardless of their diameter, there are provided adjustment means which are constituted by an adjustment comb 21 provided with a set of teeth 23, each whereof can slide in the respective guide 11. The adjustment comb 21 further comprises an external grip means 25 to allow the user to move the adjustment comb 21 easily into the correct position, which is conveniently marked on the body of the binding machine with notches or the like, according to the type of disk to be used.

In order to facilitate the arrangement of the sheets 9 in the binding position a tray 27 is advantageously provided on which it is possible to rest the stack of sheets 9.

In order to instead facilitate the loading of the disks 5 in the guides 11 a hopper 29 is advantageously provided, having a plurality of dispensing holes 31 which are connected to corresponding feed holes 33 which, when the hopper 29 is in the operating position, are located at the guides 11.

In order to ensure that the disks 5 are arranged correctly in the guides 11, the hopper 29 has a hopper comb 35 provided with a plurality of teeth 37 inserted in the dispensing holes 31. The hopper comb 35 further comprises a pair of wings 39 which are suitable to engage corresponding seats 41 formed in the internal walls of the hopper 29, so as to adjust the position of the hopper comb 35 according to the dimensions of the disks to be fed.

Advantageously, the hopper comb 35 can be arranged in a fully closed position, in which the teeth 37 fully close the dispensing holes 31, so as to use the hopper as a portable disk container. For this purpose, the upper opening of the hopper can of course be closed with a press-on lid or the like (not shown).

The binding machine according to the invention further comprises a punching device preferably arranged at the base of the binding machine, which substantially comprises a plurality of punches 43 which are associated with a movable plate 45 by means of a per se known mechanism which is not described herein for the sake of brevity.

Each punch 43 has a double-T cross-section, which comprises a central stem 47 which connects two half-circles: a passive half-circle 49 and an active half-circle 51. Each punch 43 comprises an active end 53 and a base portion 55 which is rigidly fixed to the plate 45. The active end 53 is conveniently provided with a region 57 in which the passive half-circle 49 is omitted.

Figure 10:
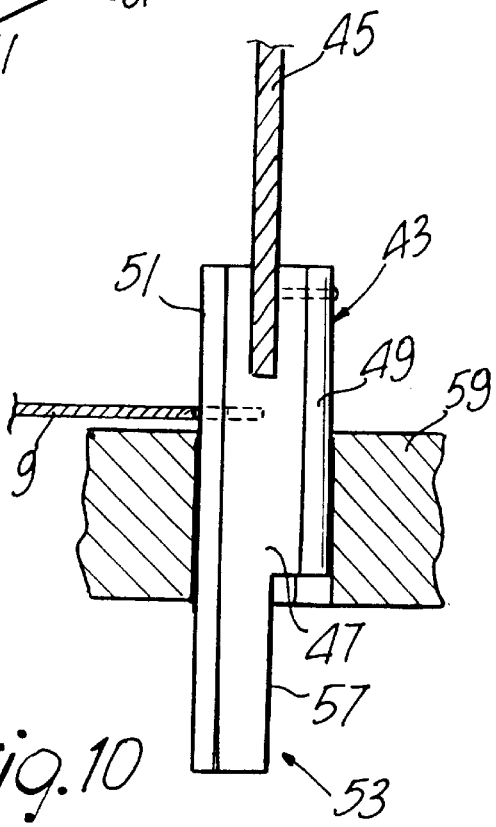
FIG. 10 is a partial side elevation view of a punch affecting a sheet.
Figure 11:
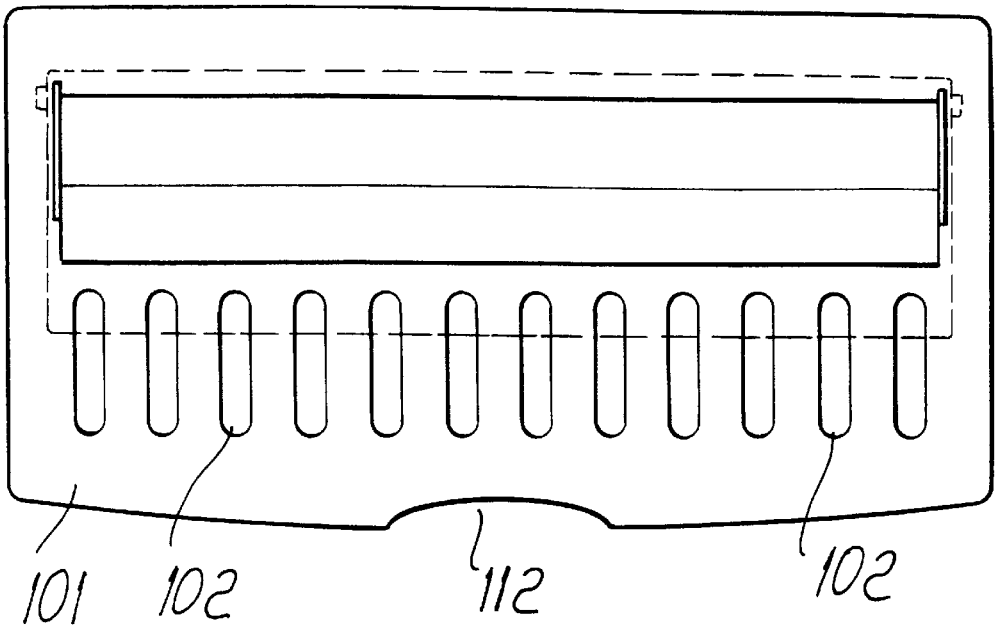
FIG. 11 is a plan view of a covering element of the binding machine according to the present invention, according to a second embodiment.
Figure 12:
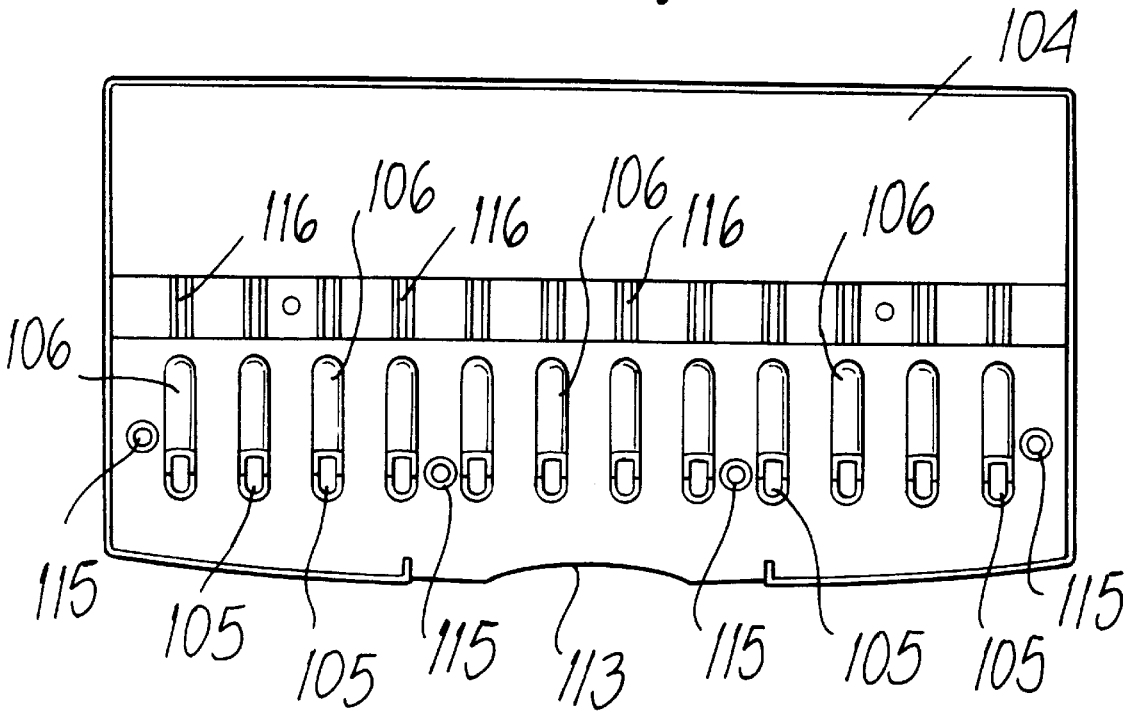
FIG. 12 is a plan view of an element inside which seats are formed for accommodating the disks in the second embodiment of the binding machine according to the present invention.
Figure 13:
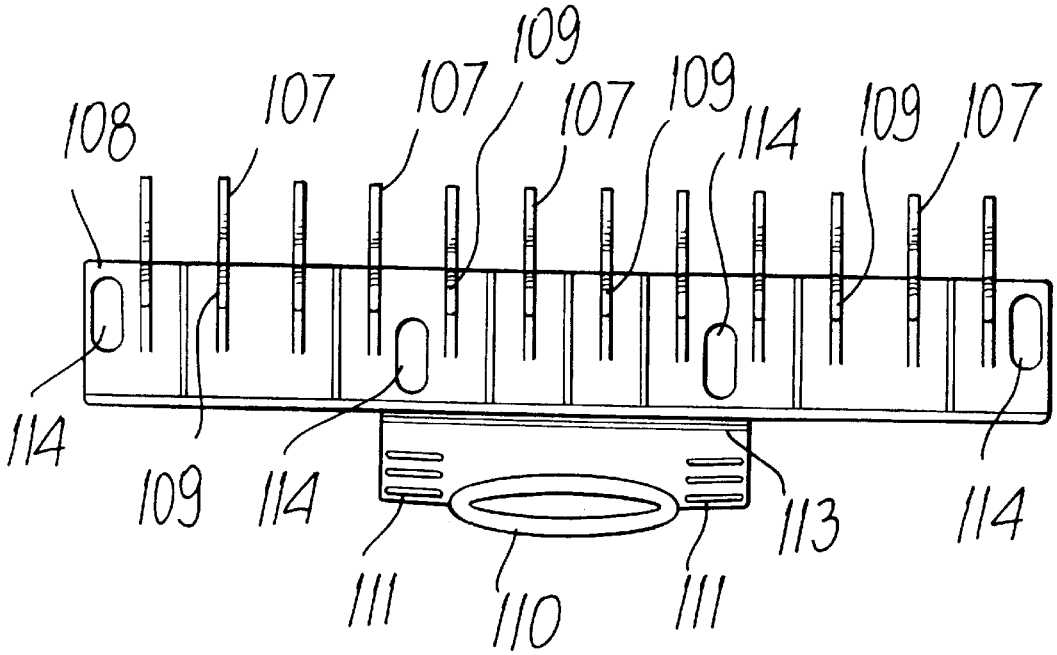
FIG. 13 is a plan view of an element for adjusting the seats of the disks in the second embodiment of the binding machine according to the present invention.
Figure 14:
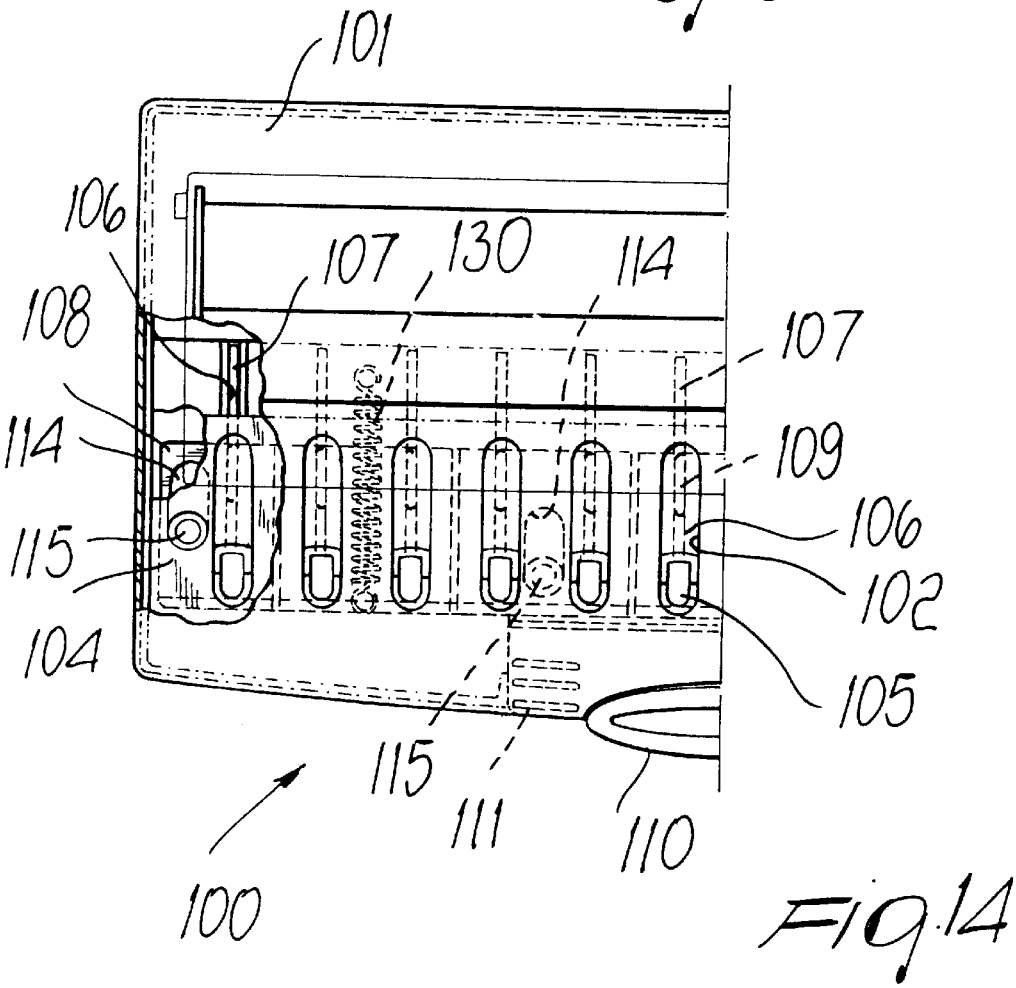
FIG. 14 is a partial plan view of the second embodiment of the binding machine according to the present invention.

The punches 43 cooperate with a base plate 59 provided with a plurality of seats 61, which have a double-T cross-section corresponding to the cross-section of the punches 43 and in which said punches fit during punching, as shown in FIG. 10.

Figure 9:
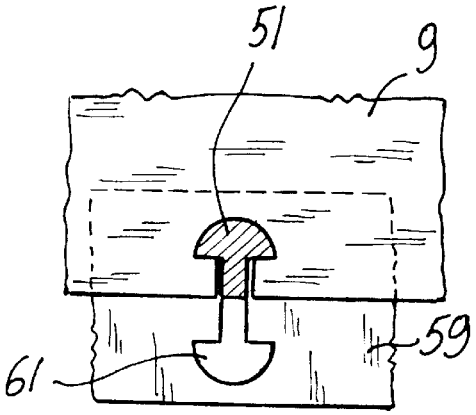
FIG. 9 is a sectional plan view of a punch affecting a sheet.

During punching, a stack of sheets 9 is rested on the plate 59 so that the edge of the sheet lies substantially on the centerline of the seats 61, as shown in FIG. 9; when the punch 43 enters the seat 61, the sheet 9 is cut, forming the seat 7 which is then engaged by the respective disk 5 during binding.

Binding occurs in a very simple way. It is in fact sufficient to rest a stack of sheets 9, which are conveniently punched and provided with seats 7, on the tray 27 so that their edge lies at the binding position 13. By lowering the lever 17, the sheets are pressed onto the disks, which enter the respective seats 7. During the lowering of the lever 17, the rod 15 too is lowered, allowing the sheets to engage the disks.

Once the bound booklet has been extracted, a new row of disks is arranged in the binding position by gravity and by sliding along the guides 11.

Figure 1:
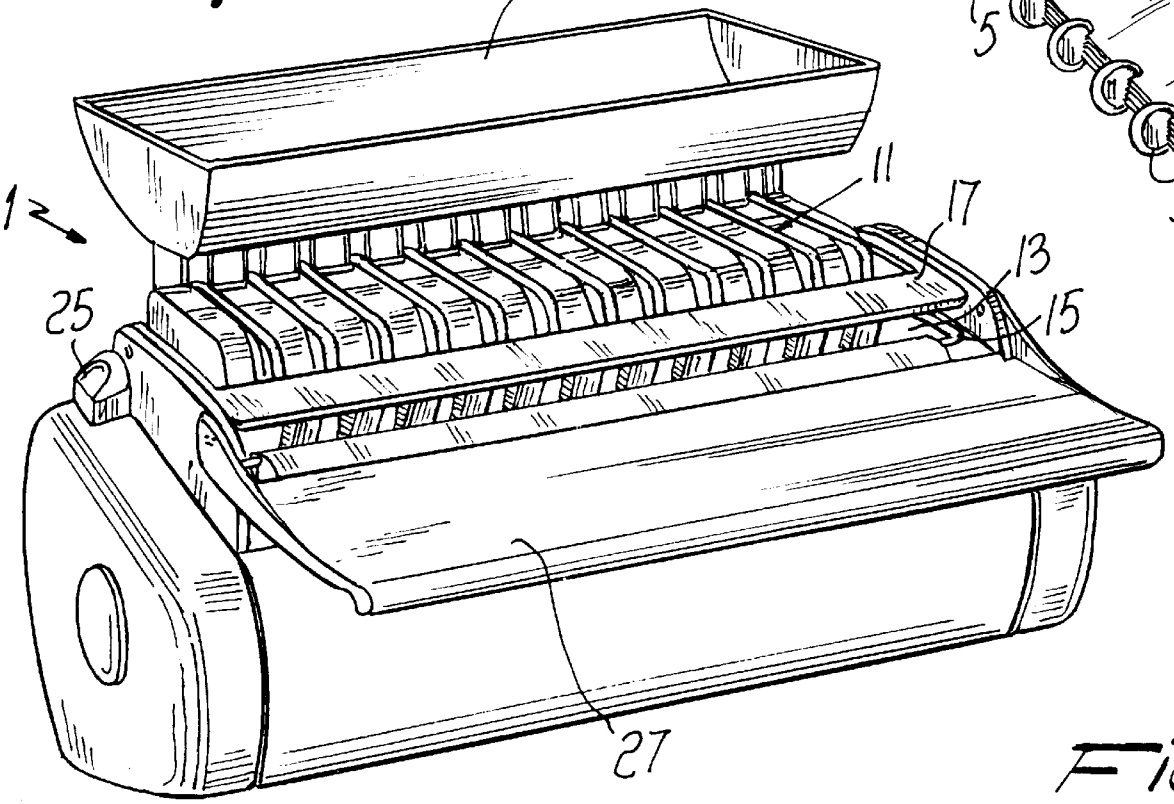
FIG. 1 is a schematic perspective view of the binding machine according to the present invention in a first embodiment.
Figure 4:
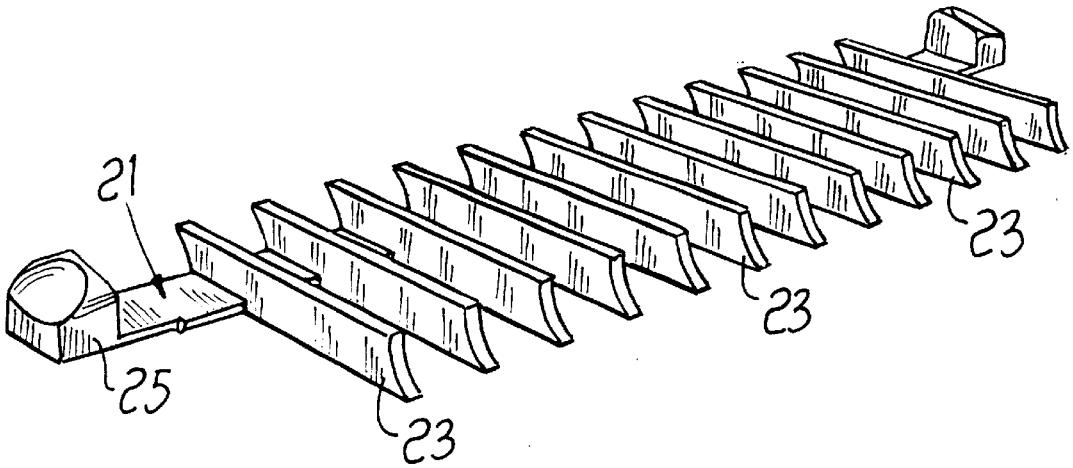
FIG. 4 is a perspective view of the adjustment means.
Figure 5:
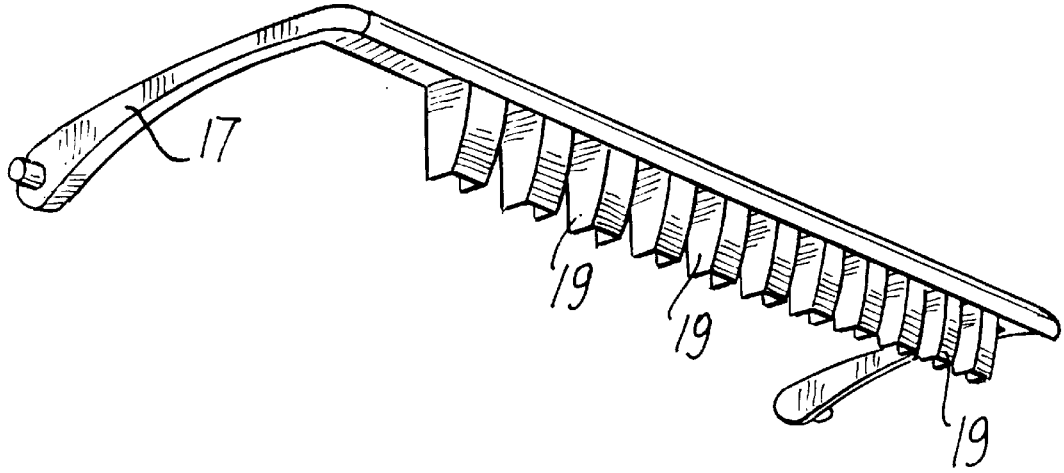
FIG. 5 is a perspective view of the presser lever.
Figure 6:
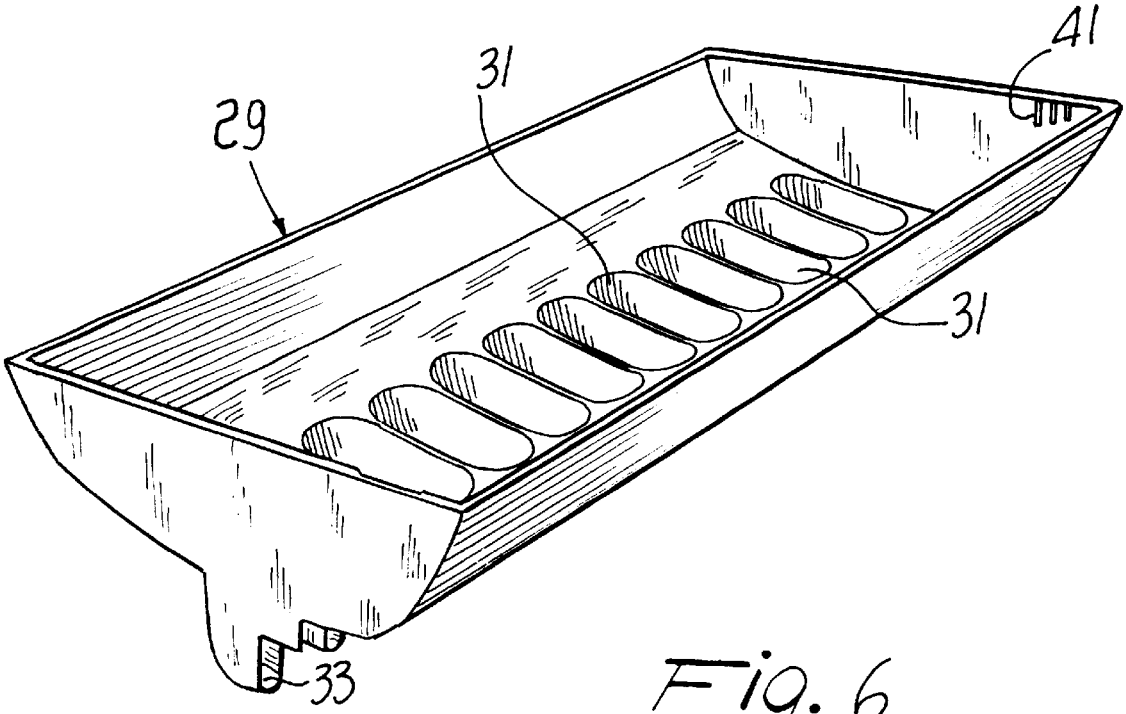
FIG. 6 is a perspective view of the hopper.
Figure 7:
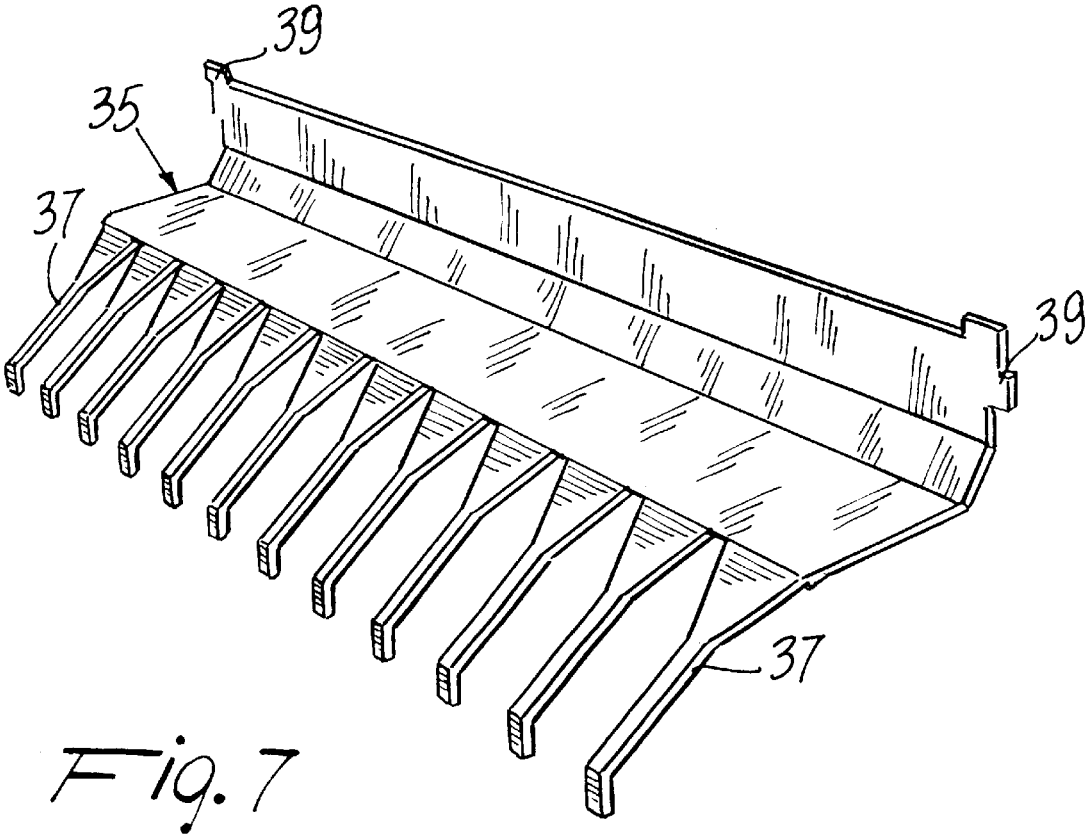
FIG. 7 is a perspective view of the hopper comb.
Figure 8:
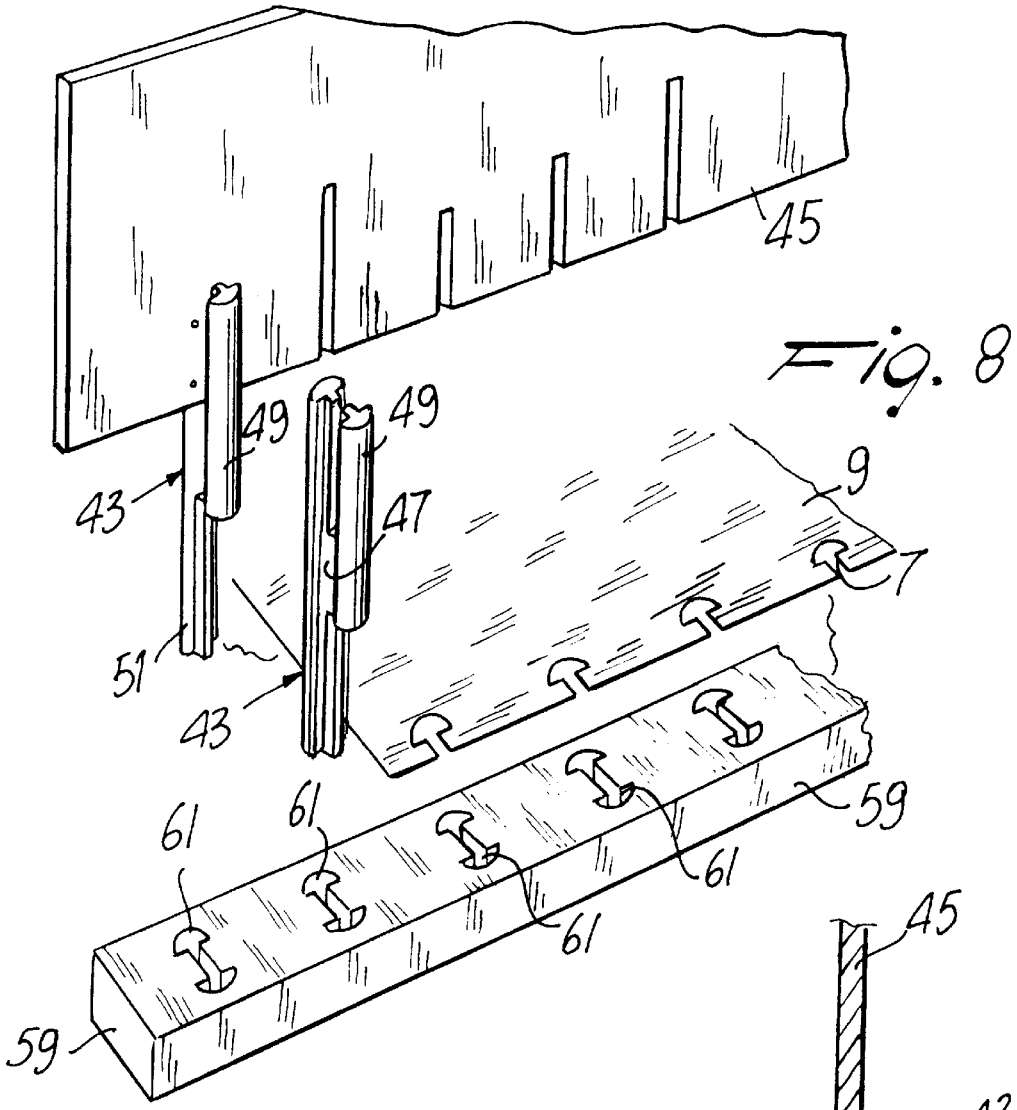
FIG. 8 is a partial exploded perspective view of the punching device.

It is readily apparent from the description of the binding machine 1 and from the FIGS. 1 and 4 that the ends of the teeth 23 of the adjustment comb 21 form, along with the rod 15, disc accommodation slot means where the disks are accommodated, at the binding position 13, aligned in a row. As clearly shown in FIG. 4, the teeth ends 23 have an arcuated wedge-shaped configuration. The extension of the slot means can be varied by slidingly moving said teeth 23 in a respective said guide of the conveyor means 11. It is so possible to correctly set in position both by vertical and longitudinal location adjustment, at said binding position 13, disks 5 having different diameters.

Figure 15:
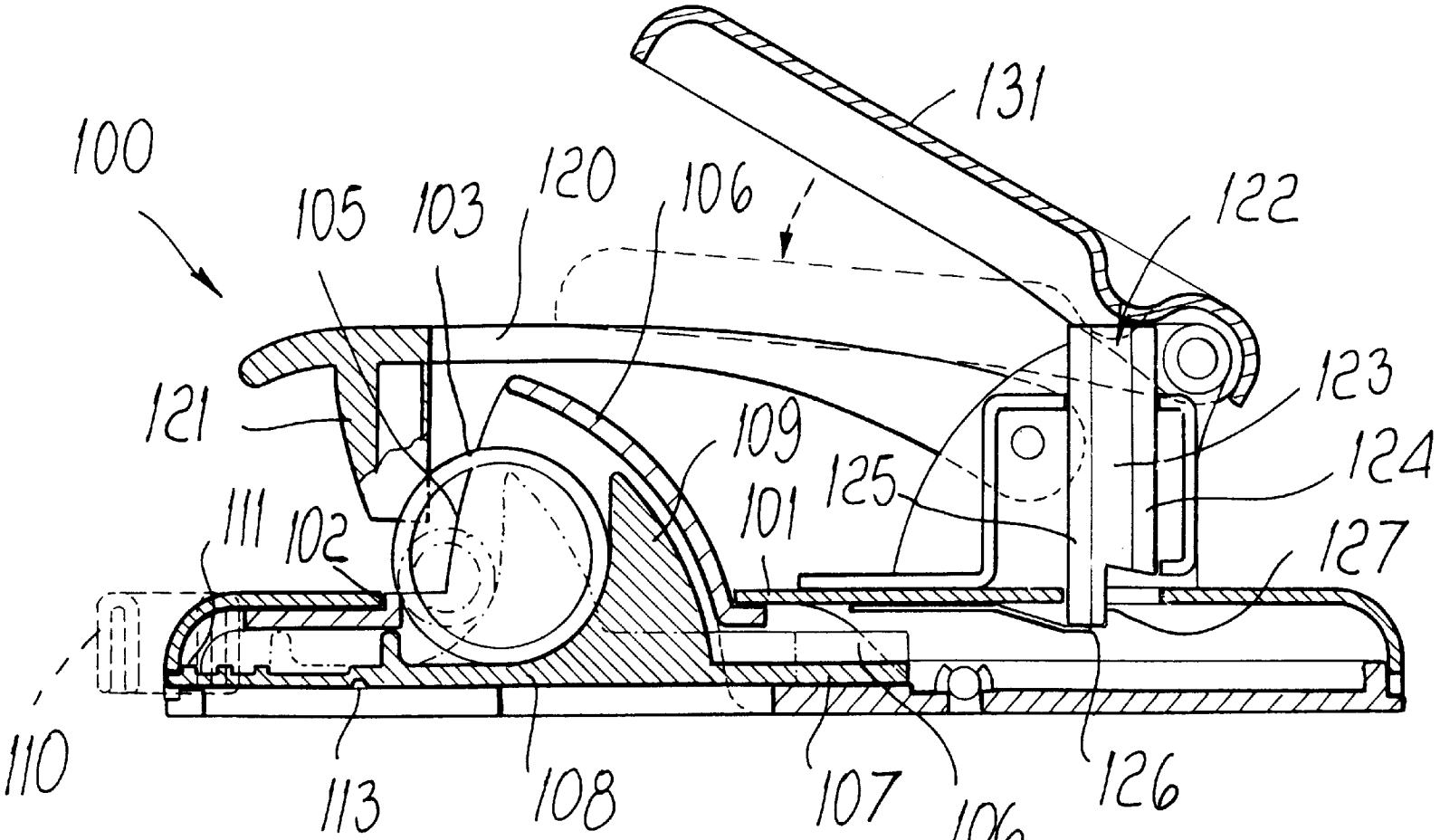
FIG. 15 is a sectional side elevation view of the second embodiment of the binding machine according to the present invention.

With reference now to FIGS. 11 to 15, the binding machine according to the present invention, in its second embodiment, generally designated by the reference numeral 100, comprises an upper element 101 which is provided with a plurality of slots 102 meant to form part of the seats in which disks 103 possibly having different diameters, as shown in FIG. 15, are accommodated.

A second plate-like element 104 is arranged below the first element 101 and also has a plurality of slots 105 which have a curved portion, designated by the reference numeral 106, which protrudes upward and partially covers the slots 105; said curved portion is suitable to fit within the slots 102, so as to protrude above the first element 101.

The plate-like element 104 also has a plurality of grooves 116 which are arranged at the slots 105 and to the rear thereof and allow to insert a plurality of teeth 107 formed on adjustment means which are constituted by an adjustment comb 108 which fits below the second plate-like element 104 and is also provided with a cusp-shaped portion 109 at each one of the teeth 107; said cusp-shaped portion is suitable to fit within the arc-like portion 106 of the second plate-like element 104.

In this manner, the adjustment comb 108 is arranged below the second plate-like element 104 so that the cusp-shaped portion 109 is inserted below the arc-like portion 106 and the first element 101 rests like a cover on top of the two elements 108 and 104.

The adjustment of the adjustment comb 108 is provided in order to adapt disks having different diameters within the corresponding seats.

The cusp-shaped portion 109 of each one of the teeth 107 in fact forms a resting portion for one of the disks 103, which abuts, at the opposite end, against the edge of the slot 105 of the second plate-like element 104.

In this manner, the cusp-shaped portion 109 of the adjustment comb 108 allows, through an extraction movement thereof with respect to the second plate-like element 104, to form the suitable seat for accommodating the disks 103 according to their diameter.

The extraction of the adjustment comb 108 is entrusted to the user's action on a handle 110 which is provided in the central part of the comb 108 and has, laterally to the grip point, a plurality of raised portions 111 which are arranged on both sides of the handle 110 and define the protrusion of the adjustment comb 108 with respect to the plate-like element 104 that lies above it.

In practice, each one of the raised portions 111 is suitable to engage the outer edge of the covering element 101, so as to form the space for accommodating the corresponding disk 103 in the seat constituted by the coupling between the first element 101, the second plate-like element 104 and the adjustment comb 108.

The first covering element 101 and the second plate-like element 104 have, at a central edge region, a recess designated by the reference numerals 112 and 113 respectively. The recesses are suitable to facilitate the flexing of the handle portion 110 of the adjustment comb 108, so as to make the raised portions 111 pass beyond the edge of the covering element 101, so as to extract the adjustment comb 108 with respect to the second plate-like element 104.

For this purpose, the handle portion 110 of the adjustment comb 108 has a groove 113 which allows to give greater elasticity to the handle portion 110 and thus allows the raised portions 111 to slip below the edge of the first covering element 101.

The translatory motion of the adjustment comb 108 is entrusted to translatory motion slots 114 which are provided at regular intervals on the surface of the adjustment comb 108 and in which corresponding pins 115 engage; said pins protrude from the lower surface of the second plate-like element 104 and are thus directed towards the adjustment comb 108.

The translatory motion of the adjustment comb 108 therefore occurs through the movement of the slots 114 with respect to the pins 115, which are fixed.

The binding machine according to the invention also has a first lever 120 which is pivoted at a rear region of the first covering element and is suitable to allow to bind a plurality of sheets on which seats, suitable to accommodate the disks 103, have been formed beforehand.

Each disk 103, which has a double-T cross-section, thus enters the corresponding seat formed in the sheets, not shown, through the action of the lever 120, which has a presser 121 which allows the sheets arranged below the lever 120 to slide along the arc-like profile formed by the arc-like portions 106 of the second plate-like element 104 and to enter so that each seat straddles the corresponding disks 103.

A second perforation lever 131 is also pivoted at a rear portion of the first covering element 101, and a plurality of pressers 122 are connected thereto and are meant to act on the edge portion of the sheets at the seats provided for the disks 103.

The pressers 122 are actually punches which form the seats in the sheets in which the disks 103 are then accommodated.

The punches 122 have a double-T cross-section which comprises a central stem 123 which connects two half-circles: a passive half-circle 124 and an active half-circle 125. Each punch 122 comprises an active end 126, which conveniently has a region 127 in which the corresponding passive half-circle is omitted and enters a slot formed on a plate in which the respective punches engage and on which the sheets to be perforated are arranged.

In this manner, the shapes of the punches are formed on the plate and thus engage said plate, perforating, in their vertical translatory motion, the sheets arranged on the plate.

It should be noted that the punch region 127 constitutes a guide for the vertical descent of the punch into the seats formed on the base plate and also constitutes an abutment element for the sheets to be punched, which are thus rested against said portion 127 in order to allow their perfect alignment and precise punching.

Finally, elastic means 130 are provided which are connected to the adjustment comb 108 and to the second plate-like element 104 in order to keep the comb tensioned and therefore to keep the raised portions of the comb engaged with the outer edge of the plate-like element 104.

Operation of the above-described binding machine is evident from the above description and it is also evident that the manual positioning of the disks 103 in the corresponding seats is facilitated by the presence of the arc-like elements 106 in which the disks 103 fit and by the presence of the cusp-shaped portion 109 of the adjustment comb 108, which allows to precisely position the disk in the intended position according to its diameter.

The adjustment of the extraction of the comb 108, which occurs by engaging the raised portions 111 against the edge of the first plate-like element 101, thus allows to keep each disk 103 constantly engaged between the cusp-shaped portion 109 and the outer edge of the second plate-like element 104.

In practice it has been observed that the binding machine according to the invention fully achieves the intended aim and objects, since it allows to easily bind a plurality of sheets automatically and at low cost.

The binding machine thus conceived is susceptible of numerous modifications and variations, all of which are within the scope of the inventive concept; all the details may also be replaced with other technically equivalent elements.

In practice, the materials employed, so long as they are compatible with the specific use, as well as the dimensions, may be any according to requirements and to the state of the art.

The disclosures in Italian Utility Model Application No. MI97U000596 and in Italian Patent Application No. MI98A001114 from which this application claims priority are incorporated herein by reference.

What is claimed is:

1. A binding machine for binding stacked sheets with engagement seats by way of a plurality of mutually aligned disks with a double-T cross-section adapted to engage said sheet engagement seats, comprising:

a base with a binding section for binding the sheets by way of said mutually aligned disks;

disk accommodation slot means having an extension suitable for accommodating said plurality of disks, mutually aligned in a row in a binding position, at said binding section;

slot adjustment means for selectably adjusting the extension of said slot means for accommodating disks of different diameters in said binding position, said slot adjustment means being constituted by an adjustment comb provided with a set of teeth, each one of said teeth being slidable towards the binding position so as to vary longitudinally the extension of said slot means;

sheet arranging means for arranging a plurality of sheets stacked with an edge portion thereof at said binding section; and presser means for acting on said edge portion of said sheets in order to insert said disks in said engagement seats.

2. The binding machine of claim 1, further comprising conveyor means, constituted by a plurality of parallel guides, for conveying said plurality of disks in parallel rows, so as to arrange a respective row of disks in the binding position.

3. The binding machine of claim 1, further comprising a punching device for forming said seats of said sheets.

4. The binding machine of claim 1, comprising a rod pivoted at the base of the machine so as to oscillates at said binding position in contrast with elastic means to prevent said disks from disengaging from said conveyor means when no sheets are present in said binding position, said rod forming with ends of said comb teeth said slot means.

5. The binding machine of claim 1, wherein said presser means comprises a lever having a front part thereof elastically biased in a raised position and a rear part pivoted at the base of the machine, said lever having a plurality of pressers arranged so as to act on said edge portion of the sheets at said sheet engagement seats.

6. The binding machine of claim 1, wherein said sheet arranging means comprises a tray on which a stack of sheets is rested to facilitate the positioning of said sheets in the binding position.

7. The binding machine of claim 2, further comprising a hopper for feeding the disks at said conveyor means, said hopper having a plurality of dispensing holes and feed holes, said dispensing holes being connected each to a corresponding one of said feed holes arranged at the conveyor means when the hopper is in the active position.

8. The binding machine of claim 7, wherein said hopper comprises: seats formed in internal walls thereof; a hopper comb provided with a plurality of teeth which are inserted in the dispensing holes for arranging correctly the disks in said guides; and wings for engaging corresponding ones of said hopper seats, to provide adjustment of the hopper comb at various positions according to different dimensions of the disks to be fed.

9. The binding machine according to claim 8, wherein said hopper comb is arrangeable in a fully closed position, in which the teeth fully close the dispensing holes, for using the hopper as a portable container for the disks.

10. The binding machine of claim 3, wherein said punching device comprise a movable plate, and a plurality of punches which are associated with said movable plate, each one of said punches having a double-T cross-section formed by a central stem which connects two half-circles including a first passive half-circle and a second active half-circle, and each punch comprising an active end and a base portion, said base portion being rigidly fixed to said movable plate.

11. The binding machine of claim 10, wherein said active end includes a terminal region formed by said second active half-circle, and at which said passive first half-circle is missing.

12. The binding machine according to claim 10, comprising a base plate provided with a plurality of seats which have a double-T cross-section corresponding to the cross-section of the punches, and in which said punches fittingly engage during punching.

13. The binding machine of claim 1, further comprising: a plate-like element lying above said adjustment comb and provided with a plurality of slots which form said slot means for accommodating said disks; a lever; and a presser, said lever being associated with said presser for pressing said sheets provided with engagement seats so as fit over said disks.

14. The binding machine of claim 13, wherein each one of said slots of said plate-like element is provided with a respective arc-like portion which partially extends above the slot.

15. The binding machine of claim 14, wherein said plate-like element comprises grooves arranged at a rear part of said slots, said adjustment comb being provided with a plurality of teeth which are adapted to engage in said slots so as to arrive at said grooves, each one of said teeth having a cusp-shaped portion which protrudes vertically with respect to a planar extension of said comb and enters said arc-like portion of said plate-like element.

16. The binding machine of claim 15, comprising an additional covering upper plate-like element arranged above said plate-like element, said additional upper plate-like element being provided with a plurality of additional slots which are arranged so as to coincide with said slots of said plate-like element.

17. The binding machine of claim 16, wherein said adjustment comb has a handle portion actuatable for imparting to said comb an extraction motion with respect to said plate-like element.

18. The binding machine of claim 17, wherein said handle portion has a plurality of raised portions which are mutually parallel, said raised portions being arrangeable so as to engage a front edge of said additional covering upper plate-like element.

19. The binding machine of claim 18, wherein said plate-like element has engagement pins protruding from a lower surface thereof, said adjustment comb being provided with a plurality of translatory motion slots adapted to be engaged by said engagement pins.

20. The binding machine of claim 19, wherein said adjustment comb has at least one longitudinal groove located at said handle portion for enhancing flexibility thereof, in order to allow disengagement of said raised portions and passage thereof beyond an edge part of said additional covering upper plate-like element to adjust extraction of said adjustment comb with respect to said plate-like element.

21. The binding machine of claim 20, wherein said plate-like element lying above said comb and said additional covering upper plate-like element have, at a central region thereof, recesses allowing flexing of said handle portion of said comb.

22. The binding machine of claim 21, wherein said disks are accommodated in said slots in constant engagement with said cusp-shaped portions located at each tooth of said adjustment comb.

23. The binding machine of claim 13, wherein said lever associated with said presser is pivoted at a rear portion of said additional covering upper plate-like element.

24. The binding machine of claim 22, further comprising elastic means connected between said adjustment comb and said plate-like element for urging said raised portions of said adjustment comb in engagement with an outer edge of said plate-like element.

25. A binding machine for binding stacked sheets with engagement seats by way of a plurality of mutually aligned disks with a double-T cross-section adapted to engage said sheet engagement seats, comprising:

a base with a binding section for binding the sheets by way of said mutually aligned disks;

conveyor means constituted by a plurality of parallel guides adapted for conveying a plurality of said disks, mutually aligned in successive rows, and for aligning in a binding position, at said binding section, one after the other, said disc rows;

an adjustment comb provided with a set of teeth having arcuated wedge-shaped ends, said teeth being each slideable in a respective said guide of the conveyor means to correctly set in position both by vertical and longitudinal location adjustment, at said binding position, disks having different diameters;

sheet arranging means for arranging a plurality of sheets stacked with an edge portion thereof at said binding section; and presser means for acting on said edge portion of said sheets in order to insert said disks in said engagement seats.

26. A binding machine for binding stacked sheets with engagement seats by way of a plurality of mutually aligned disks with a double-T cross-section adapted to engage said sheet engagement seats, comprising:

a base with a binding section for binding the sheets by way of said mutually aligned disks, said base including a base plate provided with a plurality of shaped seats;

disk accommodation slot means for accommodating said plurality of disks, mutually aligned in a row, in a binding position at said binding section;

a punching device for forming said sheet engagement seats, said punching device comprising a movable plate and a plurality of punches having each a double-T cross-section including a central stem which connects two half-circles, each one of said punches having an active end and a base portion, said base portion being rigidly fixed to said movable plate, said half circles including a passive half-circle and an active half-circle, and said active end having a region in which said passive half-circle is omitted, and wherein said shaped seats of the base plate have a double-T cross-section corresponding to the cross-section of the punches so that during punching said punches fit in said shaped seats;

sheet arranging means for arranging a plurality of sheets stacked with an edge portion thereof at said binding section; and presser means for acting on said edge portion of said sheets in order to insert said disks in said engagement seats.

* * * * *